United States Patent [19]

Klemesrud

[11] Patent Number: 4,490,960

[45] Date of Patent: Jan. 1, 1985

[54] APPARATUS AND METHOD FOR CLOSING RECLOSABLE BAGS

[75] Inventor: James H. Klemesrud, New Richmond, Wis.

[73] Assignee: Doboy Packaging Machinery, Inc., New Richmond, Wis.

[21] Appl. No.: 451,354

[22] Filed: Dec. 20, 1982

Related U.S. Application Data

[63] Continuation of Ser. No. 172,411, Jul. 25, 1980, abandoned.

[51] Int. Cl.[3] ..... B65B 51/04

[52] U.S. Cl. ..... 53/135; 53/137; 53/138 R; 53/371; 53/414; 53/415

[58] Field of Search ..... 53/414, 415, 417, 482, 53/138 A, 138 R, 374, 371, 135, 137; 493/177, 215, 262, 419, 423, 436, 454, 458, 927; 229/65

[56] References Cited

U.S. PATENT DOCUMENTS

| | | | |
|---|---|---|---|
| 805,452 | 11/1905 | Deegan | 229/65 X |
| 1,763,663 | 6/1930 | Lily | 53/482 X |
| 2,071,745 | 2/1937 | Higginbottom | 229/65 X |
| 2,138,066 | 11/1938 | Matchett | 229/65 |
| 2,343,571 | 3/1944 | Nicolas | 229/65 |
| 2,429,505 | 10/1947 | Ashman | 493/264 |
| 2,987,858 | 6/1961 | Kerker | 53/482 X |
| 3,024,962 | 3/1962 | Meister | 229/62 |
| 3,054,242 | 9/1962 | Haprisos | 53/378 |
| 3,198,512 | 8/1965 | Frei | 493/423 |
| 3,315,877 | 4/1967 | Grevich | 229/65 |
| 3,367,221 | 2/1968 | Schmermund | 53/389 |
| 3,369,950 | 2/1968 | Rosewicz | 53/415 X |
| 3,719,318 | 3/1973 | Moran | 229/65 |
| 3,720,559 | 3/1973 | Odom | 53/482 |

FOREIGN PATENT DOCUMENTS

| | | | |
|---|---|---|---|
| 347069 | 7/1960 | Switzerland | 229/65 |
| 384740 | 10/1973 | U.S.S.R. | 53/374 |

*Primary Examiner*—John Sipos

*Attorney, Agent, or Firm*—Orrin M. Haugen; Thomas J. Nikolai; Douglas L. Tschida

[57] ABSTRACT

A machine automatically applies a tin tie strip across the top of bags in a predetermined series of steps wherein the bag top is closed downwardly twice in a double fold after the tin tie strip is affixed to one of the bag side walls. Glue applied to the exposed, outside surface of the first fold holds the bag top closed in the double fold condition. Bendable lengths of the tin tie strip projecting from the leading and trailing edges of the bag side wall are sequentially bent around the bag top through full 180° turns into snug engagement with the other bag side wall as bags are moved through the machine by conveyor means.

5 Claims, 14 Drawing Figures

APPARATUS AND METHOD FOR CLOSING RECLOSABLE BAGS

This is a continuation of application Ser. No. 172,411, filed July 25, 1980, now abandoned.

BACKGROUND OF THE INVENTION

In the bag forming, closing, and handling art, it is known to apply a bendable and flexible strip across a bag top to assist in holding filled bags closed, and especially for use in reclosing bags to preserve the contents thereof after initial opening. See U.S. Pat. Nos. 3,315,877 and 3,024,962. Such strips are commonly designated as tin ties and normally comprise one or more lengths of bendable metal, such as aluminum or copper, contained within a sheath of plastic or paper material molded or sealed over the metal. As is disclosed in U.S. Pat. No. 3,315,877, the tin tie strip is affixed atop bag tops so as to provide bendable end segments freely extending beyond the bag side edges. These end segments may be bent around the bag top to hold the bag top folded closed both upon bag filling and by the user after the bag is opened.

U.S. Pat. No. 3,719,318 discloses the application of a tin tie strip to a polyethylene bag by heat sealing a film projection of the tin tie strip to a face of the bag in a separate, bag-forming operation prior to filling and closing the bag. In the course of the closing of the bag after filling, the top of the bag is rolled over and the ends of the tin tie are mechanically bent under the rolled, closed bag top within tucks formed in the end walls of the bag top.

The use of adhesive applied to the outside face of a bag wall to secure multiple folds of a closure at one end of the bag is disclosed in the aforesaid U.S. Pat. No. 3,315,877 as well as in U.S. Pat. No. 2,429,505.

Although the usefullness of tin tie strips in securing reclosable bags is well established, the packaging industry is lacking in a simple and effective way to apply tin tie strips to bag tops in the course of bag closing operations on a fully mechanized, high speed basis. It is with that need in mind that the improved machine and process disclosed herein have been developed.

BRIEF SUMMARY OF THE INVENTION

This invention is directed to a machine and method for the fully automated, high-speed closing of bags with a tin tie strip applied to bags during the closing process in such a way as to accomplish a secure closure that can be reclosed by the tin tie strip after initial opening of the bags to preserve the contents thereof.

These basic objectives and advantages are realized by the utilization of a machine which automatically carries out the sequential steps of applying glue to one side wall of the open top of a bag, applying a tin tie strip from a dispensing spool to the bag side wall over the glue and cutting off the tin tie strip with bendable links thereof projecting from the leading and trailing edges of the moving bag. Thereafter, the closing sequence is completed by folding the bag top downwardly in a double fold with the tin tie strip contained within the multiple folds, gluing the folds in place to the bag side wall by applying glue to the outside surface of the first fold, and thereafter bending the projecting lengths of the tin tie strip around the top of the bag to secure the top closure as the bags are moved through the machine by a conveyor.

Applying glue to the outside surface of the first fold, rather than to the bag side wall, advantageously permits the use of a glue dispensing nozzle positioned to dispense a bead of glue directly against the first fold, prior to the second folding operation. The bead of glue on the first fold is brought into contact with the bag side wall by the completion of the second fold to hold the double fold in place.

In the preferred machine and process, an automatically actuable scissors type of cut-off knife is positioned between a pair of continuously driven feed rollers which apply the tin tie strip to moving bags and a pair of transfer rollers located beyond the cut-off knife in the direction of bag travel. The transfer rollers are positioned to grip the bag side walls and the tin tie strip together and thereby pull the tin tie along with a moving bag until the knife severs the tin tie strip behind the bag trailing edge.

The bending of the tin tie lengths projecting from the leading and trailing edges of moving bags is effectively accomplished on a relatively high-speed, production line basis by a combination of movable and stationary contact devices. The leading edge tin tie length is first bent around the bag top in two steps. A member mounted for rotary movement across the path of bag travel first strikes the leading edge tin tie length and displaces it angularly with respect to the bag side walls. Thereafter, stationary guide means, positioned at a location to be struck by the angularly projecting leading edge tin tie length, flattens it rearwardly against the bag. The trailing edge tin tie length is subsequently bent and flattened back against moving bags in two steps by a rotary member intermittently movable across the path of moving bags and by a moving belt positioned adjacent to the bag conveyor downstream of the rotary strike member. The rotary member first displaces the trailing edge tin tie lengths to an angularly projecting position with respect to the bag side walls. The moving belt is angled inwardly towards the bag conveyor with respect to the position of bag travel, and is driven in a direction generally coinciding with the direction of bag movement, but at a greater linear speed than that of the bag conveyor. The moving belt is thus particularly effective to engage the angularly projecting trailing edge tin tie length, and progressively flatten it against the top of moving bags to complete a full 180° turn.

These and other objects and advantages of this invention disclosed herein will be readily understandable as the following description is read in conjunction with the accompanying drawings wherein like reference numerals have been used to designate like elements throughout the several views.

DESCRIPTION OF THE PREFERRED EMBODIMENT

The machine and method as set forth herein have been particularly developed for use in the final closing of filled bags. Filled bags are transported to the input side of the machine as shown at the far right side of FIG. 1*b*, after which the bags are carried through the machine, which automatically applies a tin tie strip and closes the bags. Although different types of bags, including plastic bags, may possibly be processed by this machine, it is contemplated that its primary application will be to the closing of gusseted, paper bags containing perishable items such as coffee and cookies.

Figure 1A:
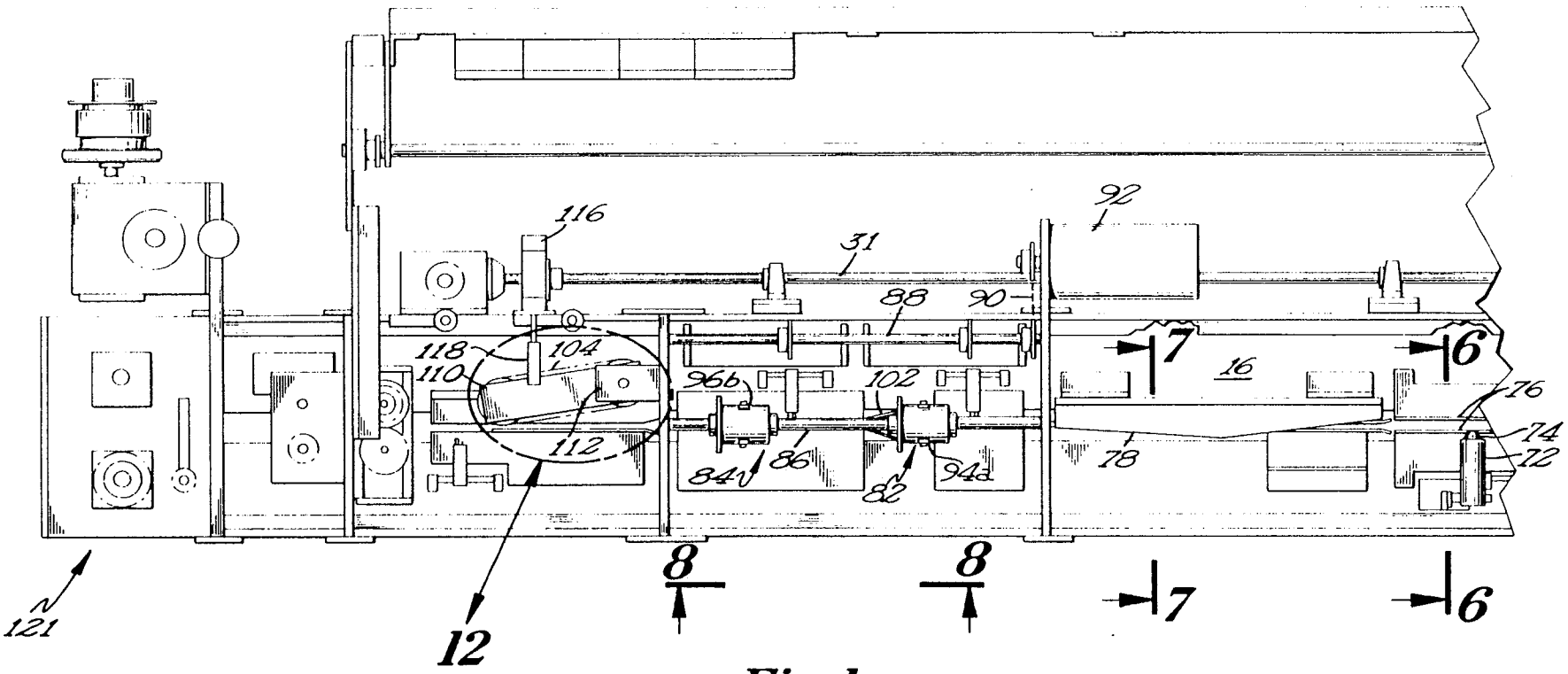
FIGS. 1*a* and 1*b* comprise together a top, plan view of the apparatus of this invention.
Figure 1B:
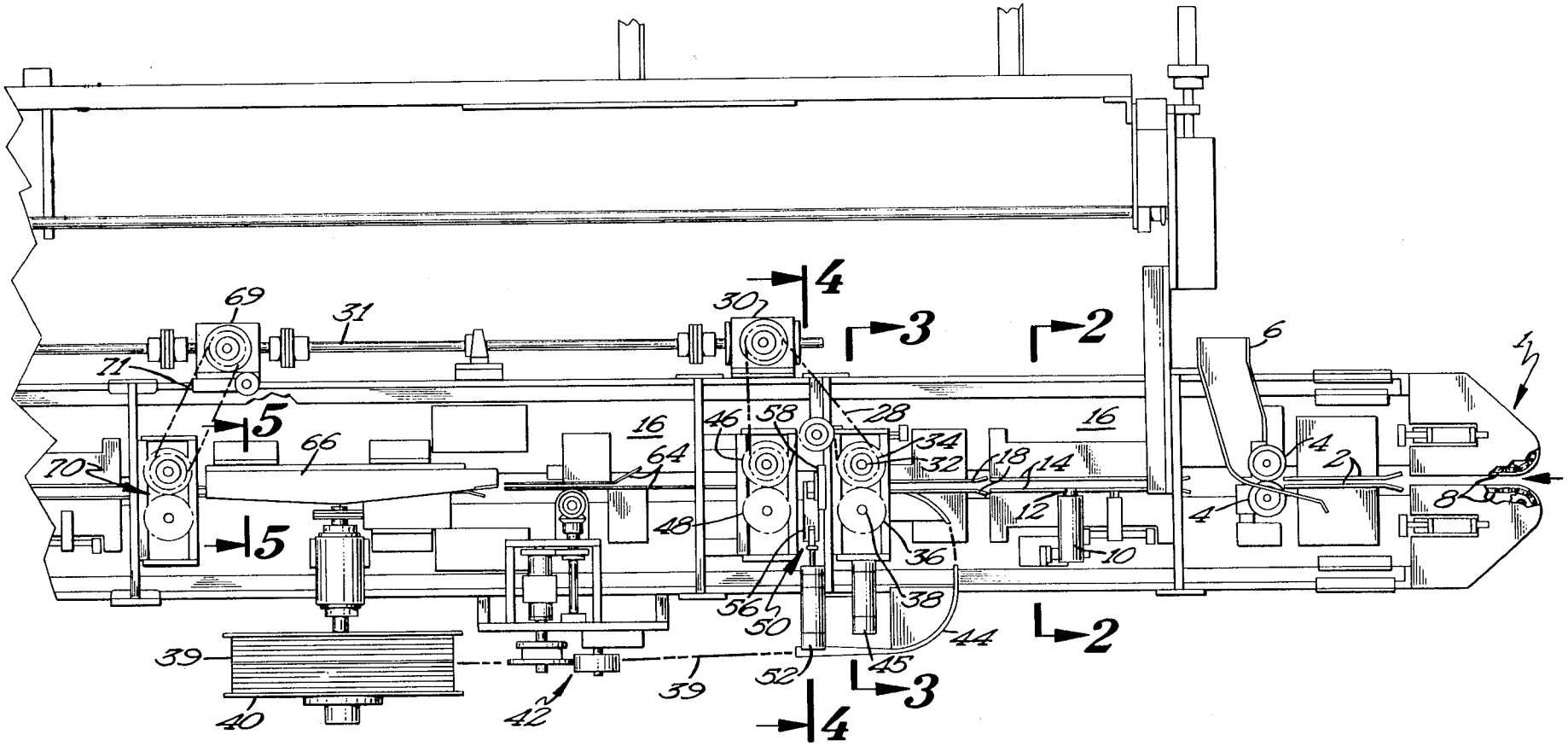

With reference to FIG. 1*b*, filled bags are initially introduced into the machine between a pair of guide housings 1 where the bag neck is gripped between a pair of flat, stainless steel carrier chains 8. Chains 8 extend over substantially the entire length of the machine, and are closely spaced apart about supporting sprockets so as to firmly grip the opposite sides of the bag neck as illustrated in FIGS. 2 through 7. Chains 8 are driven continuously and carry bags through the machine as the tin tie application and bag closing steps are performed in a predetermined sequence. As a preliminary step the gusseted, paper bags are trimmed at the top by a pair of rotary trimming discs 4. These disc blades act like scissors to shear each bag top off straight to the correct height for folding properly. Scrap material severed from the top of moving bags is discharged through chute 6.

Figure 2:
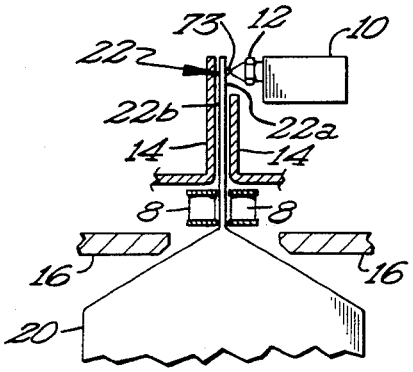
FIG. 2 is a section view taken along lines 2—2 of FIG. 1*b* and showing the first glue applicator.

After the bag trimming step, a pneumatically actuated glue applicator 10 positioned as shown in FIGS. 1*b* and 2 is utilized to apply a first bead of glue horizontally across the face of one side of each bag. Glue is precisely metered through discharge nozzle 12 of glue applicator 10. Closely spaced guide plates 14 having upstanding portions as shown support the opposite sides of the bag neck as glue is applied thereto. As may best be understood by reference to FIG. 2, carrier chains 8 are supported above a deck 16 apertured as shown to receive the neck 22 of moving bags 20. The front side wall of each bag neck 22, as viewed from in front of the machine with respect to FIGS. 1*a* and 1*b*, is indicated by reference numeral **22*a*, and numeral 22*b* indicates the opposed, rear side wall. Glue dispensing nozzle 12 is located so as to apply a narrow strip or bead of glue across bag side wall 22*a*** near the top of the bag. This first bead of glue is placed on the bag side wall so as to coincide with the centerline of a tin tie strip subsequently applied thereover.

Figure 3:
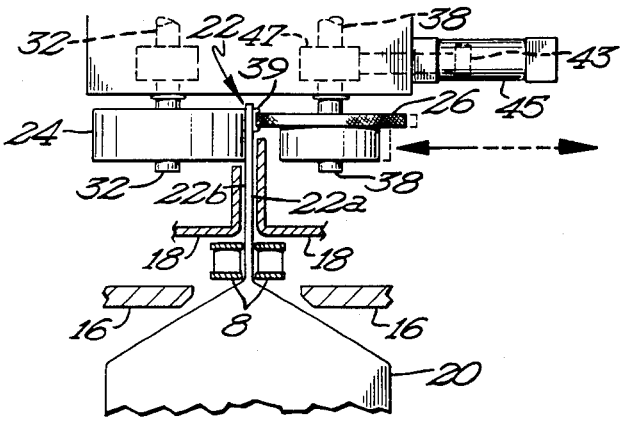
FIG. 3 is a section view taken along lines 3—3 of FIG. 1*b* and showing the tin tie feed rollers.

A pair of guide plates 18 shaped and positioned similarly to those shown at 14 serve to guide moving bags between a pair of tin tie feed rollers 24 and 26 after the glue bead is applied. Rollers 24 and 26 may be driven in any convenient manner. In practice, input power to feed rollers 24 and 26 is provided by a drive chain 28 driven from a power takeoff and speed reducer 30 connected to a main power input shaft 31. As may best be understood by reference to FIGS. 1*b* and 3, feed roller 24 is mounted on a shaft 32 carrying a sprocket 34 about which drive chain 28 is guided. A gear drive 36 in turn transmits power from shaft 32 to shaft 38 on which knurled feed roller 26 is mounted. Tin tie ribbon 39 supplied from a spool 40 is gripped between feed rollers 24 and 26, and pulled forward against side wall **22*a* of moving bags over the first glue bead. Tin tie ribbon 39 is fed from spool 40 to an intermediate feed and guide roll assembly 42 and thence into a flexible guide tube 44 from which it is picked up by feed rollers 24 and 26. The drive and mounting arrangement for feed rollers 24 and 26 is such that these rollers are driven continuously. A power cylinder 45 connected to knurled feed roller 26 through shaft 38 and its bearing block 47 serves to move this roller laterally inwardly and outwardly into and out of cooperative, tin tie feeding engagement with backup roller 24. This lateral, shifting movement of feed roller 26 is indicated by arrows in FIG. 3. As tin tie ribbon 39 is gripped by feed rollers 24 and 26 and fed forwardly against bag face 22*a* over the glue bead, its free leading end is picked up and gripped between a pair of transfer rollers 46 and 48 positioned downstream of feed rollers 24 and 26 in the direction of bag travel. Transfer rollers 46 and 48 are driven from chain 28 through a sprocket and gear arrangement substantially the same as that used for feed rollers 24 and 26. Transfer rollers 46 and 48 are constructed and positioned to grip moving bags, and the tin tie ribbon 39, the same as rollers 24 and 26 as shown in FIG. 3. Tension is maintained on the tin tie ribbon 39 until it is cut off by the gripping and pulling action of transfer rollers 46 and 48**.

Figure 4:
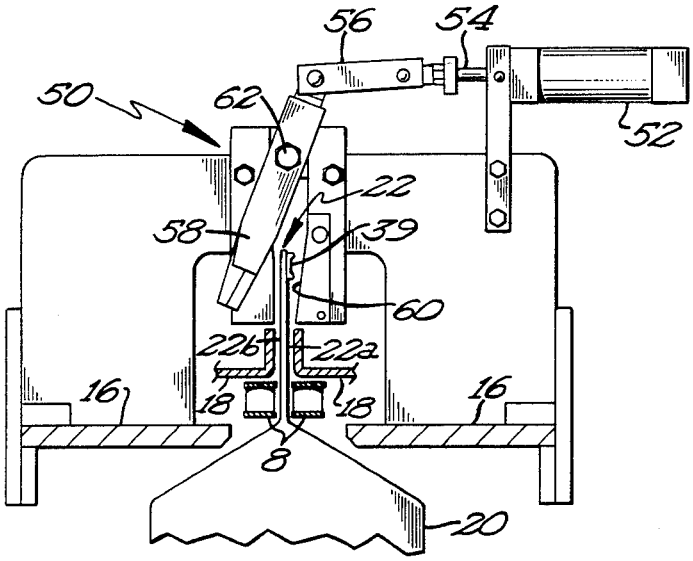
FIG. 4 is a section view taken along lines 4—4 of FIG. 1*b* and showing the cut off knife assembly for the tin tie.

The cutting of the tin tie ribbon to leave a predetermined length of tin tie extending across the width of each bag neck is accomplished by a cut off knife assembly 50. As is shown in FIGS. 1*b* and 4, the knife assembly is actuated by a power cylinder 52 having a piston 54 coupled to a linkage mechanism 56. This linkage mechanism is in turn connected to pivotal knife blade 58. A stationary knife blade 60 is positioned to cooperate with movable blade 58 to provide a scissors type of cut off action. Movable blade 58 pivots about point 62 through the reciprocal actuation of piston 54 and link 56. When piston 54 is retracted in the direction indicated by the arrow in FIG. 4, blade 58 is pivoted to the phantom line position shown in FIG. 4 in its cutting stroke. Power cylinders 45 and 52 for tin tie feeding actuation of roller 26 and operation of cut off knife assembly 50 are controlled by an electric eye arrangement not shown so that the tin tie strip applied to each bag will have bendable lengths thereof projecting beyond leading and trailing edges of the bag.

Figure 5:
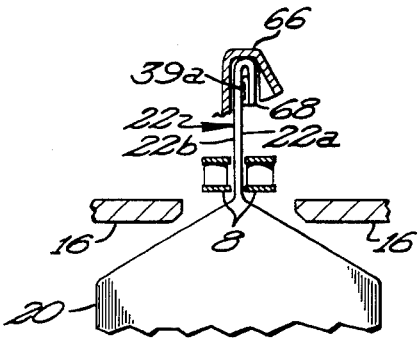
FIG. 5 is a section view taken along lines 5—5 of FIG. 1*b* and showing the first bag folder.

Beyond transfer rollers 46 and 48 in the direction of bag travel are another pair of guide plates 64 which direct the moving bag with a tin tie strip **39*a* applied thereto into a first bag top folder 66. Folder 66** is of a conventional, well known construction. Preferably, it comprises an inverted U-shaped folding plate as shown in FIG. 5. Folding plate 5 inclines downwardly from right to left as viewed in FIG. 1 to progressively fold the top of each moving bag over and impart a first fold thereto. FIG. 5 shows the top of a bag 20 folded downwardly over the face of side wall 22*a* to provide a first fold 68 with tin tie strip 39*a* lying between this first fold and bag side wall 22*a*.

A set of compression rollers 70 serve to compress and flatten first fold 68. Rollers 70 are driven by a chain 71 from a power take off 69 which also receives its driving power from shaft 31.

Figure 6:
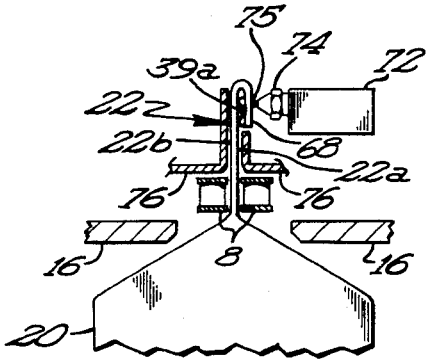
FIG. 6 is a section view taken along lines 6—6 of FIG. 1*a* and showing the second glue applicator.

A second pneumatically actuated glue applicator 72 having a dispensing nozzle 74 is positioned as shown in FIGS. 1*a* and 6 beyond compression rollers 70. Guide plates 76 located adjacent to glue applicator 72 serve to support bag neck 22 as glue is applied thereto from nozzle 74. Dispensing nozzle 74 is located to apply a second bead of glue to the outside surface of first fold 68 adjacent the top thereof as indicated at 75 in FIG. 6.

Figure 7:
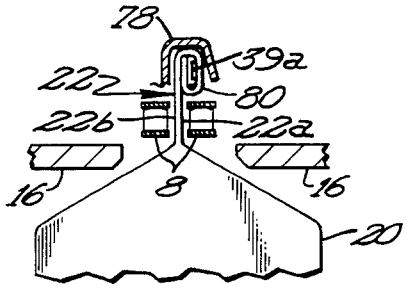
FIG. 7 is a section view taken along lines 7—7 of FIG. 1*a* and showing the second bag folder.
Figure 13:
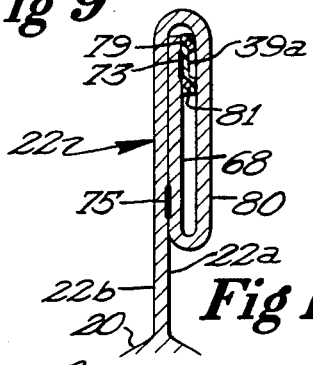
FIG. 13 is an enlarged scale section view of a bag as illustrated in FIG. 7 after the second folding operation of the bag top has been completed.

Thereafter, a second folder 78 of identical construction as first folder 66 and shown in FIGS. 1*a* and 7 engages the top of moving bags 20 to fold the top thereof downwardly a second time. The second fold 80 formed by folder 78 is shown in FIGS. 7 and 13. As may be noted most clearly by reference to FIG. 13, the second folding operation brings first fold 68 into a position lying against bag side wall 22*a* with second glue bead 75 located therebetween. Thus, second glue bead 75 serves to hold the bag top in the double folded condition shown in FIG. 13. Also, the first glue bead holding tin tie strip 39*a* to first fold 68 is indicated by reference numeral 73 in FIG. 13. Tin tie strip 39*a* is contained as shown between bag top folds 68 and 80. The tin tie ribbon utilized is flexible material, and as shown in FIG. 13 may comprise a strip of plastic having a pair of wires 79 and 81 embedded in top and bottom longitudinal segments thereof. Tin tie strip 39*a* is preferably on the order of 5/16s of an inch wide and has wire strands 79 and 81 molded therein.

Figure 9:
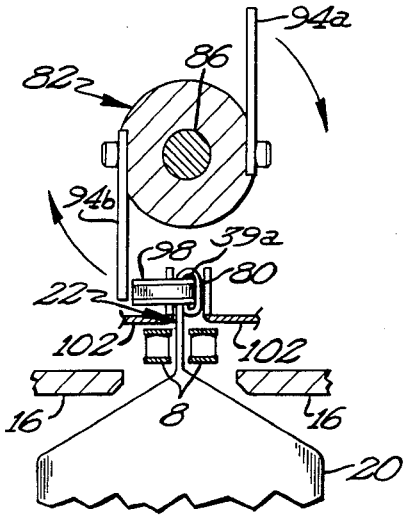
FIG. 9 is a section view taken along lines 9—9 of FIG. 8 and showing the first rotary arm assembly.
Figure 10:
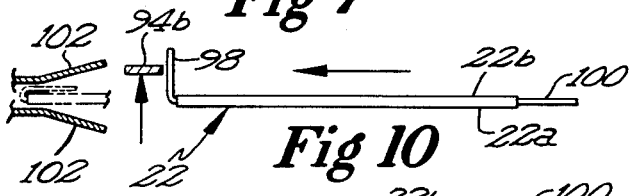
FIG. 10 is a fragmentary, top plan view taken along lines 10—10 of FIG. 8 at the first rotary arm assembly.
Figure 8:
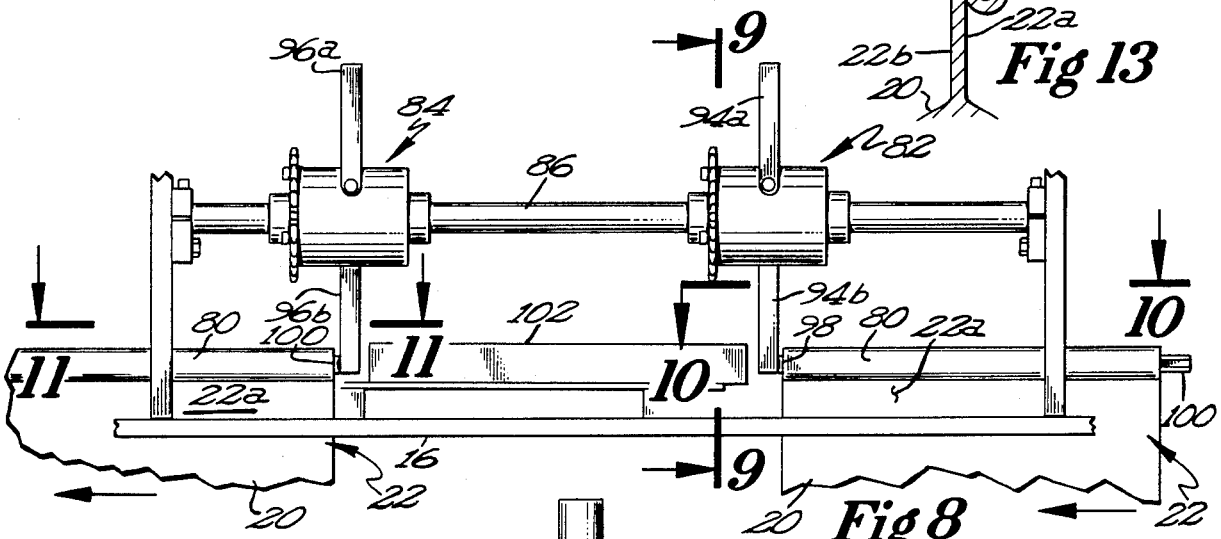
FIG. 8 is a section view taken along lines 8—8 of FIG. 1*a* and showing the rotary arm assemblies for bending the tin tie strip applied to the bag.

As stated above tin tie strip 39*a* will have bendable lengths or segments thereof projecting from the leading and trailing edges of bag neck 22. These projecting tin tie segments must be folded back flat against the top of bag neck 22. This is accomplished by a combination of elements comprising in part a pair of rotary arm assemblies generally indicated by reference numerals 82 and 84 in FIGS. 1*a*, 8, and 9. These arm assemblies are of identical construction, and serve to initially bend or turn the projecting ends of the tin tie strip 90° from the vertical plane of the upright bag neck 22. Rotary arm assemblies 82 and 84 are rotatably mounted on a shaft 86, and are driven by a sprocket and chain drive arrangement (not shown) from an intermediate drive shaft 88. Power is supplied to shaft 88 by a drive chain 90 from a power takeoff and speed reducer 92 drivingly coupled to main drive shaft 31. Rotary arm assemblies 82 and 84 are identical. Each carries a pair of paddles or arms 94*a*, 94*b* and 96*a*, 96*b*, respectively. It is to be noted by reference to FIGS. 8 and 9 that rotary arms 94*a*, 94*b* and 96*a*, 96*b* are mounted for rotary movement across the path of travel of bags being transported by carrier or conveyor chains 8. These rotary arms revolve in a generally vertical plane oriented transversely to the direction of travel of conveyor chains 8. First rotor assembly 82 is located along the path of bag travel so that one of its rotary arms 94*a* or 94*b* will strike leading edge tin tie length 98 and bend it as illustrated in FIGS. 8, 9, and 10. The action of rotary arm 94*b* as illustrated in FIGS. 9 and 10 is effective to bend leading edge tin tie length 98 to substantially a 90° angle with respect to the vertical plane of bag side walls 22*a* and 22*b*.

Figure 11:
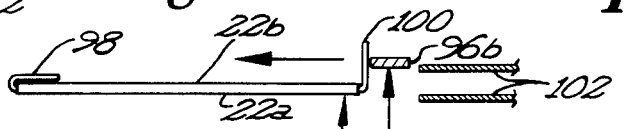
FIG. 11 is a fragmentary top plan view taken along lines 11—11 of FIG. 8 at the second, rotary arm assembly.

Located immediately beyond rotary arm assembly 82 in the direction of bag travel is a stationary guide comprised of a pair of upright plates 102. Stationary guide 102 is shown in FIGS. 8, 10, and 11. The space between upright guide plates 102 is such that bag neck 22 can just pass therebetween. Thus, as bag neck 22 enters the space between stationary guide plate 102, angularly extending, leading edge tin tie projection 98 strikes one of the upright plates 102 and is flattened rearwardly into overlying position against bag neck rear wall 22*b* to complete a full 180° turn.

Trailing edge tin tie projection 100 remains straight as it passes between upright guide plates 102. Rotary arm assembly 84 is located downstream of stationary guide 102 in the direction of bag travel so that its rotary arms 96*a* and 96*b* are in a position to strike trailing edge tin tie projection 100. As illustrated in FIGS. 8 and 11, this occurs after a bag neck 22 passes rotary arm assembly 84. Rotary arm 96*b* is shown in FIGS. 8 and 11 striking trailing edge tin tie projection 100 and deflecting it to a substantially 90° angle with respect to the vertical plane of bag neck side walls 22*a* and 22*b*.

Figure 12:
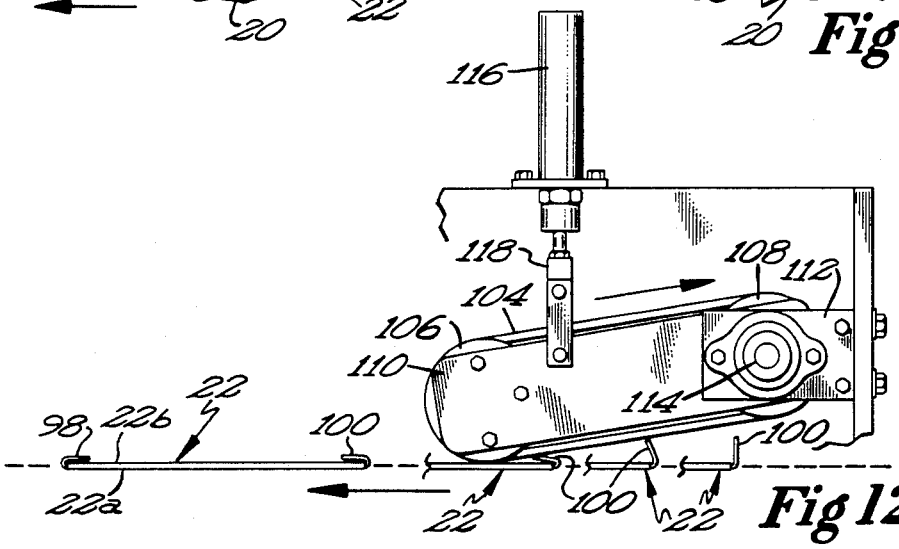
FIG. 12 is a fragmentary, enlarged view taken at the point indicated on FIG. 1*a* and showing the belt assembly utilized for final flattening of the trailing tin tie projection on a bag being closed.

The final flattening of trailing edge tin tie projection 100 is accomplished by a rough belt 104 located downstream of rotary arm assembly 84. Belt 104 is guided around shivs 106 and 108 so as to be supported at an angle with respect to guide chains 8 and the path of bag travel as shown in FIGS. 1*a* and 12. Mounting plate 110 for belt shivs 106 and 108 is pivotally supported at one end on a pivot block 12 for swinging, pivotal movement in a horizontal plane about pivot pin connection 114. The other end of mounting plate 110 is connected to the reciprocating piston 118 of a rigidly mounted power cylinder 116. The purpose of power cylinder 116 and its piston 118 is to pivot belt 104 inwardly and outwardly about pivot point 114 with respect to the path of bag travel so as to avoid contact of belt 104 with leading edge tin tie projection 98 and the resultant damaging or reopening of that projection. The intermittent actuation of power cylinder 116 is controlled by an electric eye located so as to not activate power cylinder 116 for the extension of piston 118 and the pivotal movement of belt 104 to the position shown in FIGS. 1*a* and 12 until after the leading edge tin tie projection 98 has passed by the belt 104. Belt 104 is traveling in the direction indicated by the directional arrow in FIG. 12 at a linear speed which is greater than that at which bags 20 are being conveyed by carrier chains 8. This difference in speed and the angular orientation of belt 104 as shown most clearly in FIG. 12 causes trailing edge tin tie projection 100 to be progressively flattened by belt 104. In FIG. 12 projection 100 is shown fully flattened against the rear side wall 22*b* of a bag neck 22 after its full 180° turn has been completed by moving belt 104. After a bag 20 has passed belt 104, piston 118 of power cylinder 116 is automatically retracted by the aforesaid electric eye so as to swing belt 104 out of the way to clear leading edge tin tie projection 98 of the next bag passing by.

Generally indicated by reference numeral 121 at the output end of the machine in FIG. 1*a* is a coder assembly. This assembly functions through the use of an ink wheel, type wheel and rubber backup roll to code the top, folded area of the bag.

The operational sequence as set forth above comprises the initial steps of trimming the bag top, applying a first glue bead 73 to one bag side wall by glue applicator 10, and then applying a tin tie strip 39*a* over glue bead 10. After a first top fold 68 is formed by folder 66, a second glue bead 75 is applied to the outside surface thereof as shown in FIG. 6, and the bag top is folded down a second time at folder 78. The double folded bag top with glue beads 73 and 75 is shown clearly in FIG. 13. Applying glue bead 75 to the top, outside surface of the first fold 68 allows the convenient placement of nozzle 74 close to this bag surface. It is difficult to get a glue nozzle sufficiently close to moving bags, under first fold 68, to apply the second glue bead 75 directly to the surface of bag side wall 22*a* against which first fold 68 is folded. The tin tie strip is securely retained between folds 68 and 80 as shown in FIG. 13. Thereafter the bag closing process is completed by bending leading and trailing tin tie projections 98 and 100 through full 180° turns by means of rotary arm assemblies 82 and 84, stationary guide 102, and belt flattener 104. The positioning of stationary guide 102 between rotary arm assemblies 82 and 84 ensures that angularly deflected leading edge tin tie projection 98 is flattened back against the bag top before trailing edge tin tie projection 100 is deflected outwardly 90° by the second rotary arm assembly 84.

Bendable tin tie lengths 98 and 100 extend beyond the leading and trailing edges of bag neck 22 approximately $\frac{5}{8}$ to $\frac{7}{8}$ of an inch. This is accomplished by the use of a control arrangement including cylinder 45 and an electric eye (not shown) positioned adjacent to the feed rollers 24 and 26. When the eye senses an approaching bag, air cylinder 45 is activated to extend its piston 43 and shift knurled wheel shaft 38 inwardly towards shaft 32. Piston 43 is attached to bearing block 47 supporting shaft 38 as shown in FIG. 3. The closing of rollers 24 and 26 will start the feeding of tin tie ribbon 39 from spool 40 in front of the leading edge of the bag. As the bag passes the electric eye, cylinder 45 will retract to stop the feeding of tin tie ribbon. Simultaneously, cylinder 52 for cut-off knife 50 is actuated and a strip of tin tie 39*a* is cut off. The control timing is such that movable knife blade 58 operates intermittently to sever the tin tie ribbon with bendable length 100 projecting rearwardly beyond the bag trailing edge.

The application of a reclosable tin tie strip to filled bags during closing as disclosed herein reduces bag and closing costs in comparison to the use of special bags with preapplied tin ties. The above described apparatus and process permits the high speed application of tin tie strips and the closing of bags at speeds on the order of seventy bags per minute, depending on bag width.

It is anticipated that various changes may be made in the construction and operation of the machine disclosed herein, as well as in the bag closing process, without departing from the spirit and scope of the invention as defined by the following claims.

What is claimed is:

1. Apparatus for closing bags with a tin tie strip for reclosing of bags after opening, comprising:

(a) conveyor means for moving open-topped bags having opposed, front and rear side walls past a series of elements arranged in a predetermined sequence to accomplish the closing of such bags;

(b) a series of said elements comprising, sequentially, in the direction of bag travel;

(1) a first glue applicator in the form of a nozzle positioned in close proximity to the path of bag travel to apply glue to the face of one side wall of a moving bag proximate the top thereof;

(2) means for feeding and applying a flexible tin tie strip from a tin tie strip supply generally horizontally across said one side wall of the bag over the glue deposited by said first applicator nozzle, with bendable lengths of said tin tie strip projecting beyond the leading and trailing edges of said one side wall of the bag, said applying means comprising a pair of cooperating feed rollers controlled to revolve continuously during bag closing operation, said feed rollers being intermittantly moved towards one another for simultaneously gripping between said feed rollers a strand of tin tie and the opposed side walls of a bag being transported by said conveyor means in substantial alignment with the location on the bag top where glue has been applied by said first applicator nozzle to thereby dispense a strip of tin tie of predetermined length and apply same by pressure from said feed rollers to said one side wall of a moving bag over said glue;

(3) a first folding device operative to fold the open top of the moving bag downwardly over the face of said one side wall and to thereby form a first fold with the tin tie strip between said first fold and said one side wall;

(4) a second glue applicator in the form of a second nozzle positioned in close proximity to the path of bag travel to apply glue to the outside, exposed surface of said first fold;

(5) a second folding device operative to fold the top of said moving bag downwardly a second time to thereby form a second fold with said surface of said first fold having said glue thereon lying against said one side wall of the bag, whereby the top of the bag is held in a double-folded, closed condition by the glue deposited from said second applicator nozzle;

(c) means movable across the path of travel of bags being transported by said conveyor means to strike the bendable length of said tin tie strip projecting beyond the leading edge of said one side wall of the bag for bending it to a position where it projects angularly with respect to said bag side walls, said movable means being mounted for rotary movement in a generally vertical plane oriented transversely to the direction of travel of said conveyor means and stationary guide means positioned beyond said movable means in the direction of bag travel at a location to be struck by said projecting leading edge tin tie length and thereby flatten it rearwardly against the other one of said opposed bag side walls; and (d) bending means positioned beyond said stationary guide means in the direction of bag travel and movable to strike said trailing edge tin tie length and bend it to an angularly projecting position with respect to said bag side walls, and contact means including an endless belt angled inwardly toward said bags with respect to the direction of bag travel and positioned adjacent to said conveyor means beyond said movable means in the direction of bag travel in the path of said angularly projecting trailing edge tin tie length including means for driving said endless belt in a direction generally coinciding with the direction of movement of said conveyor means at a greater linear speed than said conveyor means, whereby said endless belt is operative to movably engage said angularly projecting trailing edge tin tie length and flatten it against the other one of said bag side walls;

(e) means for intermittently moving said feed rollers relatively towards each other for simultaneously gripping between said feed rollers a strand of tin tie and the opposed side walls of a bag being transported by said conveyor means is substantial alignment with the location on the bag top where glue has been applied by said first applicator nozzle to thereby dispense a strip of tin tie of predetermined length from said supply and apply same by pressure from said feed rollers to said one side wall of a moving bag over said glue.

2. Apparatus for closing bags as defined in claim 1 wherein:

said endless belt is pivotally mounted for swinging movement of its inwardly angled end towards and away from said conveyor means to avoid contact with the flattened leading edge tin tie length of each passing bag; and power means connected to said endless belt for intermittently moving said inwardly angled belt end towards and away from said conveyor means as bags move by, said power means being operative in response to control means to move said inwardly angled belt end towards said conveyor means for flattening said trailing edge tin tie length only after the leading edge tin tie length of each bag has moved past said endless belt.

3. Apparatus for closing bags as defined in claim 1 wherein:

said means for applying a tin tie strip further comprises a cut-off knife positioned beyond said feed rollers in the direction of bag travel, and actuating means intermittently operable to actuate said knife to cut off a strip of tin tie dispensed from said supply spool with a predetermined length of tin tie strip projecting from the trailing edge of said one side wall of a moving bag.

4. Apparatus for closing bags as defined in claim 3 wherein:

said cut-off knife is a scissors type of knife.

5. Apparatus for closing bags as defined in claim 3 wherein:

said means for applying a tin tie strip further comprises a pair of cooperating transfer rollers located beyond said cut-off knife in the direction of bag travel and positioned to grip said opposed bag side walls with one of said transfer rollers bearing against the tin tie material applied by said feed rollers, whereby said transfer rollers pull the tin tie material along with a moving bag until said knife cuts off the tin tie strip.

* * * * *